United States Patent [19]

Kaltner

[11] 3,961,605

[45] June 8, 1976

[54] ENGINE COOLING ARRANGEMENT

[75] Inventor: Hermann Kaltner, Wolfsburg, Germany

[73] Assignee: Volkswagenwerk Aktiengesellschaft, Wolfsburg, Germany

[22] Filed: Jan. 31, 1975

[21] Appl. No.: 546,072

Related U.S. Application Data

[63] Continuation of Ser. No. 378,941, July 13, 1973, abandoned.

[52] U.S. Cl. ..... 123/41.05; 123/41.58; 180/54 A

[51] Int. Cl.[2] ..... F01P 7/02

[58] Field of Search ..... 123/41.04, 41.05, 41.06, 123/41.58, 41.7; 236/101, 49; 180/54 A; 165/128; 336/59, 30

[56] References Cited

UNITED STATES PATENTS

| | | | |
|---|---|---|---|
| 2,358,663 | 9/1944 | Scott-Iversen | 180/54 A |
| 2,434,090 | 1/1948 | Alton | 236/49 |
| 3,318,524 | 5/1967 | Kehm | 236/10 |

*Primary Examiner*—William E. Wayner
*Assistant Examiner*—William E. Tapolcai, Jr.
*Attorney, Agent, or Firm*—Brumbaugh, Graves, Donohue & Raymond

[57] ABSTRACT

In a vehicle having an internal combustion engine enclosed in an engine housing, two vertically spaced openings in the housing permit the passage of cooling air around the engine. The lower opening has a movable cover which is normally closed when the vehicle is moving. When the vehicle is stationary, however, an automatic actuating device moves the cover to an open position. The actuating device is responsive to a condition of the vehicle normally indicating that the vehicle is stationary, e.g. the temperature in the engine housing or the pressure in the engine intake manifold.

10 Claims, 3 Drawing Figures

ENGINE COOLING ARRANGEMENT

This is a continuation of application Ser. No 378,941, filed July 13, 1973 now abandoned.

BACKGROUND OF THE INVENTION

The present invention relates to an arrangement for cooling an internal combustion engine for a vehicle, such as an automobile, when the vehicle is at a standstill or slowly moving, so that difficulties in restarting the heated engine are avoided. Such difficulties occur, in particular, when the vehicle is stopped and the engine shut off following operation under a full load, especially with high ambient temperatures and in a vehicle having an air-cooled engine. The fuel that remains in the fuel pump and/or in the carburetor float chamber evaporates due to the high temperatures within the engine housing, making the engine difficult to restart.

To avoid difficulties in restarting a heated engine, additional cooling of the engine should be provided when the primary cooling system for the engine no longer functions at optimum effectiveness. In water-cooled engines, for example, the primary cooling system for the engine ceases to function when the engine is shut off and the cooling water stops circulating. In air-cooled engines, the primary cooling system functions less effectively whenever the flow of cooling air over the engine is reduced (i.e. whenever the automobile slows down). A critical reduction in cooling air flow may occur even while the vehicle is still moving slowly.

German Pat. No. 1,007,564 discloses a cooling arrangement for an internal combustion engine in which the housing for the engine is provided with two vertically spaced openings, the lower of which is provided with a swiveling flapvalve cover. Air is forced by a blower through the engine housing from the upper opening to the lower opening. The temperature within the engine housing is controlled by opening or closing the lower opening with the swiveling flap-valve cover, which is actuated by a thermostat located within the engine housing. The patented cooling arrangement, however, is intended to cool the engine under normal operating conditions, and not to cool a heated, stationary engine in order to avoid difficulty in later restarting the engine.

Another cooling arrangement is described in "Automobiltechnischen Handbuch" (Handbook of Automotive Engineering), 16th edition 1945, at page 1194. In the described arrangement, the quantity of cooling air is adjusted in accordance with the fuel supply to the engine partly by making use of the vacuum in the engine intake manifold. Again, the cooling arrangement is not directed to overcoming the difficulties in restarting a heated engine.

SUMMARY OF THE INVENTION

The present invention is directed to a cooling arrangement for an internal combustion engine which overcomes the above-noted difficulties in restarting a heated engine. The cooling arrangement includes two openings in the housing for the engine, one being located below the other. The lower opening is fitted with a movable cover operated by an automatic actuating device. The actuating device moves the cover in response to a predetermined condition of the vehicle which is normally indicative of a generally stationary attitude of the vehicle.

The invention embodies the results of experiments showing that difficulties in restarting a heated engine can be overcome by providing two openings in the engine housing at different heights and utilizing the engine heat to effect cooling. Specifically, if the vehicle is stationary or substantially so, the heated engine produces a chimney-like effect within the engine housing. The heated air surrounding the engine rises through the housing to the upper opening and thereby causes cooler air to be drawn in from the surrounding atmosphere through the lower opening in the housing. The cooler air, in turn, is heated by the engine, cooling the engine, and rises to the upper opening to continue the cooling cycle.

While a cooling arrangement consisting simply of two openings in the engine housing might function properly when the vehicle is not in motion, operation while moving produces certain difficulties and even hazards. For example, mud and moisture may be sucked into the engine housing through the lower opening, because of its proximity to the road surface. Both materials will adversely affect the operation of the engine. In addition, where the air inlet for a heater for the vehicle passenger compartment is located within the engine housing, the likelihood that exhaust gases may be sucked in through the lower housing opening represents a substantial hazard to passengers in the vehicle. The hazard is particularly apparent in vehicles having their engines located in the rear of the vehicle adjacent the open end of an exhaust pipe.

To avoid the possible problems resulting from the use of two vertically spaced openings in an engine housing when the vehicle is in motion, a swiveling cover is provided for the lower opening. Operation of the cover is made independent of the vehicle operator by providing an automatic actuating device. The automatic actuating device moves the cover to an open position when the vehicle is generally stationary and to a closed position when the vehicle is moving.

The cover for the lower opening in the engine housing may be formed in any convenient manner and, similarly, the actuating device may be responsive to one or more of several different conditions of the vehicle. In one embodiment of the invention, the actuating device includes a temperature sensitive element responsive to the temperature within the engine housing. The actuating device thus moves the cover to an open position only at temperatures within a range which normally indicates that the vehicle is at a standstill. By appropriate selection of the range of temperatures, the inventive cooling arrangement will also not operate during cold weather. Careful selection of the temperature range thus avoids the possibility that the vehicle engine will be rapidly cooled during cold weather operation, which might also result in difficulties in restarting the engine even after only a relatively short period of standing.

In a second embodiment of the invention, the actuating device includes a pressure sensitive element connected to the intake manifold of the vehicle engine. The pressure sensitive element causes the actuating device to move the cover for the lower opening into an open position only upon sensing a pressure indicating that the engine has been shut off and, therefore, under normal circumstances, that the vehicle is stationary.

In a third embodiment of the invention, the actuating device includes an electromagnetic drive connected to a contact point which carries voltage only when the vehicle engine is running. The contact point may be connected into the ignition circuit for the engine, for example. Thus, when the engine is shut off, and the vehicle normally is at a standstill, the electromagnetic drive releases the cover to open the lower opening in the engine housing.

In vehicles having a passenger compartment heater and a heater air inlet located within the engine housing, the above described cooling arrangements may be controlled to operate in conjunction with the heater air inlet. Specifically, when the air inlet for the heater is open, the cover for the lower opening in the engine housing remains closed, even if it would otherwise be in an open position due to the action of the actuating device. The additional control is a safety device to avoid the intake of exhaust gases through the lower housing opening into the heater air inlet.

BRIEF DESCRIPTION OF THE DRAWINGS

For a better understanding of the invention, reference may be made to the following descriptions of exemplary embodiments taken in conjunction with the figures of the accompanying drawings, in which.

DESCRIPTION OF EMBODIMENTS

Figure 1:
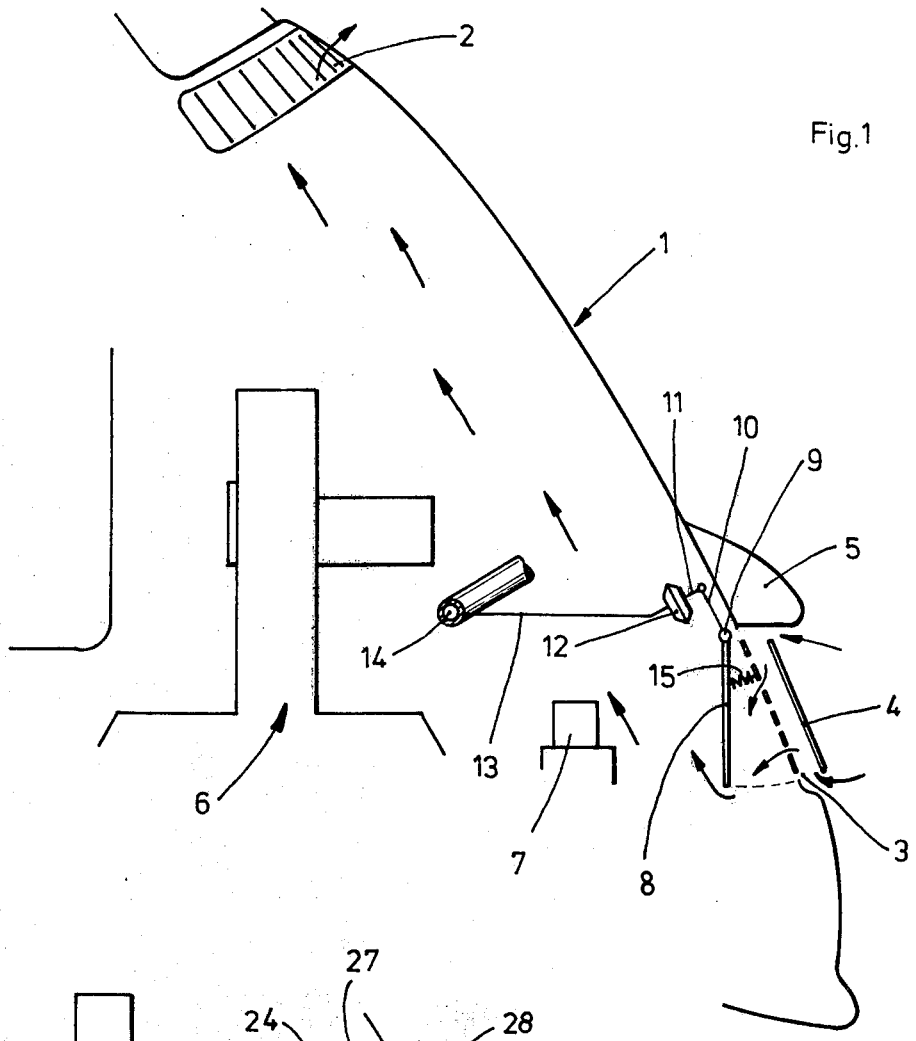
FIG. 1 is a schematic side view of a vehicle equipped with a rear air-cooled engine and a cooling arrangement according to the invention.

FIG. 1 illustrates the rear portion of an automobile equipped with a rear air-cooled internal combustion engine, generally designated by the reference numeral 6, covered by an engine hood 1. Two sets of air passage openings 2 and 3 are formed in the engine hood 1, one set 2 being placed higher on the hood than the other set 3. The lower set of air passage openings 3 is located behind the license plate 4 so that they are essentially hidden from view. The license plate 4 also provides protection against the intake of larger sized particles through the openings 3. The license plate 4 is spaced from the surface of the hood 1 to permit air to flow around the plate and into the air passage openings 3. The reference numeral 5 designates a light for the license plate 4.

With the two sets of openings 2 and 3 in the engine hood 1, air flows into the air passage openings 3, through the engine compartment and out of the upper group of openings 2, as indicated by the arrows in FIG. 1. The air thus flows over the automobile engine 6 and also the fuel pump 7 for the engine, at least in part, to cool both the fuel pump and the engine carburetor (not shown). The cooling effect of the air flow prevents evaporation of fuel in the fuel pump 7 and the engine carburetor and thereby eliminates difficulties in restarting the engine, which result from such fuel evaporation.

The air circulation results from a chimney-like effect within the engine compartment, whereby air passing over the heated engine 6 is itself heated and rises through the engine compartment to the air passage openings 2. The rising movement of the heated air causes cooler air to be drawn in through the air passage openings 3. The cooler air is, in turn, heated by the engine 6, thereby cooling the engine, and rises through the engine compartment to continue the cooling cycle. Since the air circulation, or convection, does not require mechanical assistance, such as a blower, the resultant cooling effect can be obtained even when the automobile is stopped and the engine 6 shut off.

The above described arrangement of air passage openings 2 and 3 is intended only to afford additional cooling for the automobile engine while the automobile is stationary or nearly so. Such additional cooling is necessary, particularly in an air-cooled engine, because of the significant difference in the volume of cooling air flowing over the engine (or the radiator for a water cooled engine) when the automobile is stationary, as compared to when the automobile is moving. When the automobile is moving, the upper set of air passage openings 2 alone normally permits sufficient cooling air to flow over the engine 6. Moreover, mud, water, and exhaust gases are likely to be drawn into the engine compartment through the lower openings 3, if they are left uncovered while the automobile is in motion.

To close the openings 3, a flap 8 pivoted on a spindle 9 is mounted within the engine compartment adjacent the engine hood 1. The flap 8 is actuated by an assembly responsive to the pressure in the intake manifold 14 for the engine 6. The assembly includes a pipe 13 connecting the intake manifold 14 with a vacuum box 12, which has a diaphragm (not shown) arranged within it. The vacuum box diaphragm is connected to a push rod 11 and a lever 10 articulated on the push rod. The lever 10, in turn, is rigidly connected to the spindle 9 for the flap 8.

In operation, when the engine 6 is started up, the vacuum produced in the intake manifold 14 is also produced in line 13 causing the vacuum box diaphragm to bulge toward the intake manifold (i.e. to the left in FIG. 1). The push rod 11 is also pulled to the left by the diaphragm, causing movement of the lever 10 and the spindle 9, which results in counterclockwise rotation of the flap 8. The flap 8 thus moves against the interior surface of the engine hood 1 and closes off the lower group of air passage openings 3. When the engine is shut off, the vacuum is no longer produced in the intake manifold 14 and the pressure on the vacuum box diaphragm is equalized. The bulge in the diaphragm flattens out and the push rod 11 moves back to the right in FIG. 1, so that the flap 8 may rotate in a clockwise direction away from the engine hood 1. A spring 15 located between the interior surface of the engine hood 1 and the flap 8 biases the flap toward an open position. The entire cooling arrangement is thus responsive to a condition indicating that the engine is shut off and that the automobile is not moving (barring accidental rolling of the vehicle) so that the cooling arrangement functions only when the automobile is at a standstill.

Figure 2:
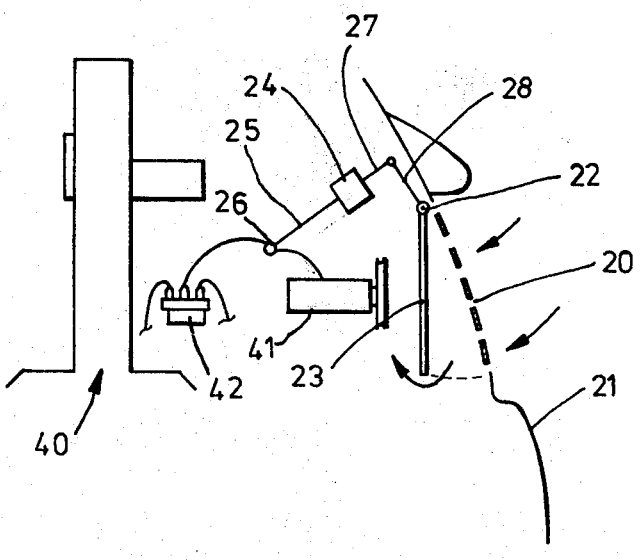
FIG. 2 is a schematic side view of a vehicle equipped with a rear air-cooled engine and a second embodiment of a cooling arrangement according to the invention.

A second embodiment of the invention is illustrated in FIG. 2, which also shows the rear portion of an automobile equipped with an air-cooled internal combustion engine. For convenience, the upper group of air passage openings is not shown. The lower group of air passage openings is designated by the reference numeral 20 and the engine hood by the reference numeral 21. A covering flap 23, generally similar to the flap 8 of FIG. 1, is pivoted about a spindle 22 adjacent the interior surface of the engine hood 21. The actuating assembly for the flap 23 is electrically connected to the ignition circuit for the automobile engine 40, so that the actuating assembly is responsive to electrical current flowing through the circuit. Thus, when the engine 40 is started and current is delivered through the ignition circuit to the spark plugs, the actuating assembly causes the flap 23 to move against the interior surface of the engine hood 21 and close off the air passage openings 20.

The actuating assembly includes an electrical contact 26 that is part of the ignition circuit, including the generator 41 and the distributor 42. An electrical conductor 25 connects the electrical contact 26 to an electromagnetic device 24, which operates in a manner similar to a solenoid valve. The electromagnetic device 24 is connected to a push rod 27 on which is articulated a lever 28. The lever 28, like the lever 20 of FIG. 1, is rigidly connected to the spindle 22 of the flap valve 23.

When the engine 40 is started and electrical current flows from the generator 41 through the ignition circuit, the electromagnetic device 24 urges the push rod 27 to the right in FIG. 2. The push rod 27 moves the lever 28, which causes the flap 23 to pivot in a counterclockwise direction toward the interior surface of the engine hood 21 and close the air passage openings 20. When the engine 40 is shut off, the electromagnetic device 24 releases the push rod 27, which is returned to the left by the action of a spring (not shown). A corresponding movement of the lever 28 rotates the flap 23 clockwise into an open position, as shown in FIG. 2. A spring, similar to the spring 15 of FIG. 1, may be provided to give positive biasing action to the flap 23.

Figure 3:
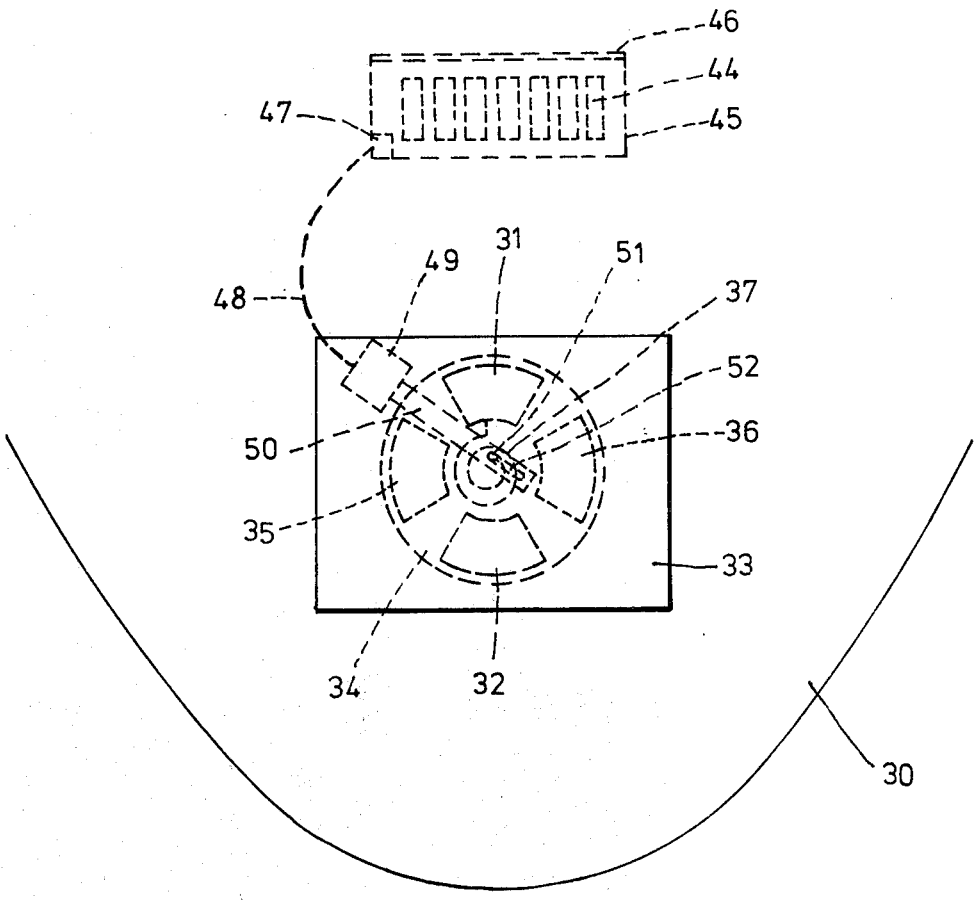
FIG. 3 is a schematic plan view of a vehicle equipped with a rear air-cooled engine and a third embodiment of a cooling arrangement according to the invention.

FIGS. 1 and 2 illustrate embodiments of the inventive cooling arrangement wherein engine parameters are used as signals to actuate the covering flaps 8 and 23, respectively. FIG. 3, however, illustrates an embodiment of the invention in which a covering flap is actuated independently of any parameters of the vehicle engine but rather is actuated in response to the temperature within the engine compartment.

In FIG. 3, the engine hood 30 of an automobile, similar to the automobiles of FIG. 1 and 2, is shown in plan, only the lower portion of the hood 30 being represented. As in the previous embodiments, the automobile license plate 33 covers a lower set of air passage openings 31 and 32. Behind the openings 31 and 32 in the engine hood 30 is a rotatable disc-like cover 34. The cover 34 is pivoted about its center and has two holes 35 and 36 in its surface which have the same dimensions as the openings 31 and 32 in the engine hood 30. The cover 34 is actuated by a temperature responsive, bimetal spiral 37.

Under normal operating conditions, the bimetal spiral 37 reacts to the temperature within the engine compartment by rotating the cover 34 so that the holes 35 and 36 in the cover 34 are not aligned with the openings 31 and 32 in the engine housing 30. The openings 31 and 32 are thus closed by the cover 34. When the temperature within the engine compartment becomes sufficiently high, for example when the automobile is standing after prolonged operation at full-load capacity, the bimetal spiral 37 rotates the cover 34 to align the holes 35 and 36 with the openings 31 and 32 in the engine housing 30. By selecting an appropriate range of temperatures, the openings 31 and 32 in the engine hood 30 will be closed except when the automobile is stationary or nearly so.

With the arrangement shown in FIG. 3, however, the automobile may remain at a standstill, thereby raising the temperature within the engine compartment, while the engine and a heater (not shown) for the passenger compartment of the vehicle are left on. If the air inlet, designated by the reference numeral 44, for the heater is located within the engine compartment, exhaust gases from the running engine may possibly be drawn in through the uncovered openings 31 and 32 in the engine hood 30 and thus into the air inlet 44 for the heater. This serious hazard for the automobile passengers can be safeguarded against by providing an appropriate override for the action of the bimetal spiral 37.

As an example, the air inlet 44 may have a cover 45 rotatably mounted along one edge on a spindle 46 to cover the inlet when the heater is not in use. A sensing device 47 adjacent the air inlet 44 senses when the cover 45 is closed against the inlet. The sensing device 47 is, in turn, connected by an electrical wire 48 in an electrical circuit with the automobile generator (not shown) and an electromagnetic device 49 similar to the device 24 of FIG. 2. The electromagnetic device 49 is connected to a rod 50 having an elongated slot 52 in its free end which receives a pin 51 projecting from the radially inward end of the bimetal spiral 37. When the sensing device 47 senses that the air inlet cover 45 is in an open position, it actuates the electromagnetic device 49 which moves the rod 50 to the left in FIG. 3. Leftward movement of the rod 50 either moves the slot 52 relative to the pin 51 so as to prevent movement of the bimetal spiral 37 and the cover 34 or pulls the pin 51 to the left, rotating the cover into a closed position. When the air inlet cover 45 is closed, the rod 50 remains in or is returned to the position shown in FIG. 3, so that the bimetal spiral 37 can rotate the cover 34 as the ambient temperature requires. An override arrangement may, of course, be used with any cooling arrangement that requires it and may be constructed as the particular situation dictates.

It will be understood that the above described embodiments are merely exemplarly and that those skilled in the art may make many variations and modifications without departing from the spirit and scope of the invention. All such modifications and variations are intended to be within such modifications and variations are intended to be within the scope of the invention as defined in the appended claims.

I claim:

1. In combination with a vehicle having a primary cooling system for an engine, a fuel system cooling arrangement supplemental to and distinct from the primary cooling system of the engine comprising:

a. means defining a first opening in said housing, at least a portion of said first opening being located higher than said fuel system;

b. means defining a second opening in said housing, at least a portion of said second opening being located lower than said fuel system;

c. movable closure means for selectively covering said second opening; and d. an automatic actuating means coupled to said closure means and operative to open said closure means only in response to a predetermined condition of the vehicle normally indicative of a heated condition within said housing conducive to the vaporization of fuel, thereby to permit convection cooling of the fuel system with air being drawn in through said second opening and flowing out through said first opening.

2. An arrangement according to claim 1, wherein the actuating means includes temperature sensitive means responsive to temperature within the housing, the temperature sensitive means causing the actuating means to move the closure means so as to uncover the second opening in response to temperatures of a predetermined range within the housing, said temperatures of a predetermined range being the predetermined condition of the vehicle.

3. An arrangement according to claim 1, wherein the closure means includes a rotatable disc-like cover and wherein the temperature sensitive means includes a bimetal spiral.

4. An arrangement according to claim 1, wherein the actuating means includes pressure sensitive means responsive to pressure in a pipe associated with the engine, the pressure sensitive means causing the actuating means to move the closure means so as to uncover the second opening in repsonse to pressures of a predetermined range within the pipe, said pressures of a predetermined range being the predetermined condition of the vehicle.

5. An arrangement according to claim 4, wherein the pipe is an intake manifold and the pressure sensitive means includes a vacuum box.

6. An arrangement according to claim 5, wherein the closure means includes a flap and wherein the actuating means further includes a linkage, responsive to the pressure sensitive means, coupling the pressure sensitive means to the flap and spring means biasing the flap toward a position in which the second opening is uncovered.

7. An arrangement according to claim 1, wherein the actuating means includes electromagnetic drive means electrically coupled to a contact point which carries voltage only when the engine is running.

8. An arrangement according to claim 7, wherein the contact point forms a part of an ignition circuit for the engine.

9. An arrangement according to claim 8, wherein the ignition circuit includes a generator.

10. A method of providing cooling for a fuel system of a vehicular engine having a primary cooling system to prevent fuel vaporization, which cooling is supplemental to and distinct from the engine cooling and which fuel system is located within a housing, said method comprising the steps of:

a. providing a first opening in the housing, at least a portion of said first opening being opening being located higher than the fuel system;

b. providing a second opening in the housing, at least a portion of said second opening being located lower than the fuel system;

c. sensing a heated condition capable of inducing vaporization of fuel in the fuel system; and d. opening said second opening in the housing only if said heated condition is present, whereby fuel vaporization will be prevented by a cooling convection flow of air induced around the fuel system.

* * * * *

UNITED STATES PATENT AND TRADEMARK OFFICE

CERTIFICATE OF CORRECTION

PATENT NO. : 3,961,605

DATED : June 8, 1976

INVENTOR(S) : Hermann Kaltner

It is certified that error appears in the above-identified patent and that said Letters Patent are hereby corrected as shown below:

Column 5, line 17, "lever 20" should read --lever 10--;
Column 6, lines 46-47, delete "within such modifications and variations are intended to be".

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*